United States Patent [19]

Muller

[11] 4,080,520

[45] Mar. 21, 1978

[54] CIRCUIT BREAKER WITH ARC QUENCHING BAFFLE ARRANGEMENT

[75] Inventor: Manfred Müller, Amberg, Germany

[73] Assignee: Siemens Aktiengesellschaft, Munich, Germany

[21] Appl. No.: 649,670

[22] Filed: Jan. 16, 1976

Related U.S. Application Data

[63] Continuation of Ser. No. 269,937, Jul. 10, 1972, abandoned.

[30] Foreign Application Priority Data

Jul. 10, 1971 Germany ..... 2134543

[51] Int. Cl.[2] ..... H01H 33/08

[52] U.S. Cl. ..... 200/144 R

[58] Field of Search ..... 200/144 R

[56] References Cited

U.S. PATENT DOCUMENTS

| | | | |
|---|---|---|---|
| 2,356,040 | 8/1944 | Ellis et al. | 200/144 R |

FOREIGN PATENT DOCUMENTS

| | | | |
|---|---|---|---|
| 1,354,577 | 1/1964 | France | 200/144 R |
| 1,051,935 | 3/1959 | Germany | 200/144 R |
| 1,093,458 | 11/1960 | Germany | 200/144 R |
| 1,160,922 | 1/1964 | Germany | 200/144 R |
| 1,200,416 | 9/1965 | Germany | 200/144 R |

*Primary Examiner*—Robert S. Macon
*Attorney, Agent, or Firm*—Kenyon & Kenyon, Reilly, Carr & Chapin

[57] ABSTRACT

An arc quenching arrangement is disclosed for a circuit breaker equipped with stationary contacts and a contact bridge having respective sides facing toward and away from the stationary contacts. The contact bridge is movable between closed and open positions to respectively contact and separate from the stationary contacts, whereby an arc is formed as the contact bridge moves away from the stationary contacts to the open position. The arc quenching arrangement quenches the arc and includes an arc guide having a longitudinal axis. The arc guide is located adjacent the side of the contact bridge facing away from the stationary contacts and is positioned such that the longitudinal axis thereof extends in a direction substantially parallel to the longitudinal dimension of the contact bridge. The arc guide has respective end portions bent in a direction away from the contact bridge; these end portions are located in the vicinity of the respective ends of the contact bridge. Each of the end portions is bent so as to form an acute angle $\alpha$ with the longitudinal axis in the range $15° < \alpha \leqq 75°$. This configuration prevents the arc from entering the region between the contact bridge and the arc guide.

7 Claims, 1 Drawing Figure

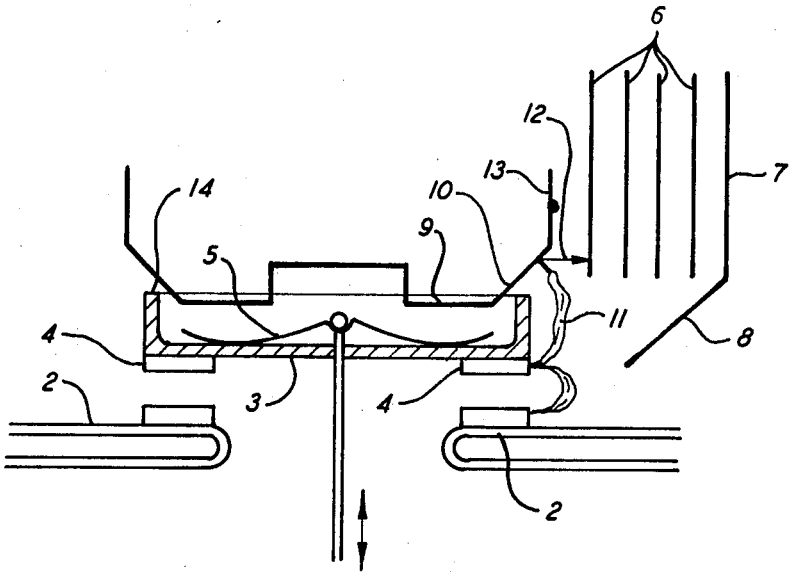
6
12
13
7
14
10
9
5
11
8
4
2
3
4
2

CIRCUIT BREAKER WITH ARC QUENCHING BAFFLE ARRANGEMENT

This is a continuation, of application Ser. No. 269,937, filed July 10, 1972 now abandoned.

BACKGROUND OF THE INVENTION

The invention relates to a circuit breaker with a quenching baffle arrangement that includes a sheet metal guide for the arc in the region of the contact bridge on the side thereof facing away from the stationary contact parts. The longitudinal axis of the guide extends parallel to the longitudinal direction of the contact bridge. The guide has bent ends in the vicinity of the ends of the contact bridge.

In alternating-current air circuit-breakers, the time for extinguishing the arc within the capacity limits of the breaker is generally one to two half-waves. To prevent the arc from standing during this time at the contact of the contact bridge, a sheet metal guide for the arc is mounted above the contact bridge to take over the arc. Although the burn-off loss at the bridge is less and the bridge can be of lighter construction, the travel properties of the arc in the quenching baffle arrangement of the kind mentioned above as well as in German Patent No. 898,019 are influenced detrimentally by the sheet-metal arc guide because the ends of the guide bent toward the contact bridge permit the arc to enter between the bridge and the guide, so that arc starting points form on the damping leaf spring which rests on the contact bridge thereby harmfully affecting the resilience of the leaf spring.

SUMMARY OF THE INVENTION

It is an object of the invention to improve the travel behavior of the arc associated with the switching operation in circuit breakers of the kind referred to above. Subsidiary to this object, it is an object of the invention to provide a circuit breaker with an improved arc quenching baffle wherein the travel behavior of the arc is improved.

The invention pertains to circuit breakers equipped with stationary contacts and a movable contact bridge. The contact bridge has respective sides facing toward and away from the stationary contacts of the breaker. The contact bridge is movable between closed and open positions to respectively contact and separate from the stationary contacts, whereby an arc is formed as the contact bridge moves away from the stationary contacts to the open position. An arc quenching arrangement is provided for quenching the arc and includes an arc guide made of sheet metal.

The invention prevents the arc from entering the region between the arc guide and the contact bridge. According to a feature of the invention, the sheet metal guide for the arc is configured so that its end portions are bent in a direction away from the contact bridge in the vicinity of the ends of the bridge at an acute angle larger than 15° and smaller than or equal to 75°.

The foregoing angle range can be defined exactly, when the teaching of the invention is based on plasma flow. The arc current has its own magnetic field which exerts a force in radial direction inwardly toward the arc. The magnetic field of the arc is proportional to the current density and is the greatest at regions of greater contraction in front of the electrodes. The increased pressure generated at these narrow points in the plasma tends to equalize toward the column because there, the cross-section becomes larger, and consequently the current density, the magnetic field and the pressure in the plasma become less. In this way, a plasma flow away from the contacts and into the column is generated.

The flow has a very high temperature because of the high current density. The jet is therefore highly conducting and is used by the arc as the current path. The high temperature in the core of the jet is maintained because of the Joule heat. For reasons of continuity, gas flows steadily from the surroundings into the jet at the foot point. These plasma jets are deflected in switchgear because of the magnetic blasting action in the arc quenching arrangements. It is therefore possible to reflect such jets in a similar manner as is possible with jets of water. German DAS 1 260 006 pertains to circuit breakers of the type which can be equipped with the arc quenching arrangement of the invention and which illustrates apparatus for effecting the blasting action referred to above.

According to the invention, the reflection of these plasma jets is utilized so that the plasma jet which starts out from the end of the contact bridge and which strikes the bent-away end parts of the sheet-metal arc guide, is reflected in such a manner that it hits the first quenching baffle; this makes it virtually impossible for the arc to enter between the sheet-metal arc guide and the contact bridge. In addition to relieving the movable contact bridge of load, this configuration of the sheet metal guide for the arc substantially influences the travel behavior of the arc and the quenching capacity. An optimal value for the inclination of the end portions of the arc guide has been found if the angle of inclination corresponds to the desired arc travel direction. To use the arc guide also as a quenching baffle, it ia advantageous if the ends of the sheet metal guide are bent essentially parallel to the quenching baffles.

As a material for the sheet-metal arc guide it has been found advantageous to use steel. So that the inclined portion of the sheet-metal arc guide begins not too far from the edge of the contact bridge, it is advantageous if the contact bridge is provided with a rim which is drawn so as to extend upwardly on all sides in a pan-like manner in the direction toward the sheet-metal arc guide.

Although the invention is illustrated and described herein as circuit breaker with arc quenching baffle arrangement, it is nevertheless not intended to be limited to the details shown, since various modifications may be made therein within the scope and the range of the claims. The invention, however, together with additional objects and advantages will be best understood from the following description and in connection with the accompanying drawing.

BRIEF DESCRIPTION OF THE DRAWING

The drawing illustrates the pertinent portion of a circuit breaker equipped with an arc quenching arrangement according to the invention. The configuration of the arc guide and its position relative to other parts of the quenching arrangement as well as to the switching contacts is shown.

DESCRIPTION OF THE PREFERRED EMBODIMENT

Referring to the drawing, the stationary contact parts are designated with reference numeral 1; these parts are U-shaped and have ends that are configured as travel rails 2 for the arc. The contact bridge 3 with its contact pads 4 are disposed adjacent the stationary contact parts 1. The actuating device for the contact bridge 3 is indicated by an arrow. A leaf spring 5 on the side of the contact bridge 3 opposite the contact pads 4 serves as a damping spring and is surrounded by a pan-like upwardly extending rim 14 of the contact bridge 3. The quenching baffle arrangement comprises baffle means in the form of arc quenching baffles 6 mounted in a quenching chamber not shown here in detail as well as the end quenching baffle 7 having end portion 8 bent off and extending into the region of the travel rail 2. The baffle arrangement further comprises the arc guide proper 9 made of electrically conducting sheet metal. The arc guide 9 has two bent-away ends 10 having an angle of inclination larger than 15° but yet smaller than or equal to 75°. The angle of inclination here referred to is the angle between the longitudinal direction of the contact bridge 3 and the direction of inclination of the ends 10. This angle of inclination is chosen so that the plasma jet 11 striking the ends 10 is reflected so that it hits the first quenching baffle 6 as indicated by the arrow 12. The inclination of the end 10, the distance of the first quenching baffle 6 and the distance of the contact bridge 3 from the arc guide 9 must therefore be matched accordingly with respect to each other in the manner indicated. The end portions 10 are further provided with bent endmost portions 13 which extend parallel to the quenching baffle 6 and can be essentially viewed as a quenching baffle.

What is claimed is:

1. In a circuit breaker having stationary contacts and a contact bridge having respective sides facing toward and away from the stationary contacts, the contact bridge being movable between closed and open positions to respectively contact and separate from the stationary contacts, whereby an arc is formed as the contact bridge moves away from the stationary contacts to the open position, and an arc quenching arrangement for quenching the arc, the arc quenching arrangement comprising baffle means comprising a plurality of baffle plates and an arc guide having a longitudinal axis and being disposed adjacent the side of the contact bridge facing away from the stationary contacts, said longitudinal axis extending in a direction substantially parallel to the longitudinal dimension of the contact bridge, said arc guide having respective end portions bent in a direction away from the contact bridge and inclined at an acute angle toward said baffle plates in the travel direction of said arc with respect to said longitudinal axis of said arc guide, said end portions of said arc guide being located in the vicinity of the respective ends of the contact bridge, each of said end portions being bent so as to form an acute angle $\alpha$ between said longitudinal axis of said arc guide and said end portions in the direction of inclination of said end portions, where $\alpha$ lies in the range: $15 < \alpha \leqq 75°$, for reflecting plasma jets generated by said arcs from the end of said contact bridge into the first of said quenching baffles of said arc quenching arrangement, thereby preventing said arcs from entering between said arc guide and said contact bridge.

2. The arc quenching arrangement of claim 1 wherein the value of said acute angle is selected in dependence upon the desired travel path of the arc.

3. The arc quenching arrangement of claim 1, said acute angle being selected so as to reflect the arc toward said baffle means.

4. The arc quenching arrangement of claim 3, each of said end portions having in turn an endmost portion bent in a direction away from the end portion proper so as to extend substantially parallel to said baffle plates.

5. The arc quenching arrangement of claim 1, said arc guide being made of sheet metal.

6. The arc quenching arrangement of claim 5 said metal being steel.

7. The arc quenching arrangement of claim 1, comprising a rim formed on the contact bridge, said rim extending toward said arc guide and imparting to the contact bridge a pan-like configuration.

* * * * *